US005363929A

United States Patent [19]

Williams et al.

[11] Patent Number: 5,363,929

[45] Date of Patent: Nov. 15, 1994

[54] DOWNHOLE FLUID MOTOR COMPOSITE TORQUE SHAFT

[75] Inventors: Jerry G. Williams, Ponca City, Okla.; Monib M. Monib, Newark, Del.; Mamdouh M. Salama, Ponca City, Okla.; David H. Schwartz, Katy, Tex.; Edward G. Dew, The Woodlands, Tex.

[73] Assignee: Conoco Inc., Ponca City, Okla.

[21] Appl. No.: 907,790

[22] Filed: Jul. 1, 1992

Related U.S. Application Data

[63] Continuation-in-part of Ser. No. 725,695, Jul. 3, 1991, abandoned, which is a continuation of Ser. No. 534,892, Jun. 7, 1990, abandoned.

[51] Int. Cl.[5] ..... E21B 4/02

[52] U.S. Cl. ..... 175/107; 428/36.3; 464/181

[58] Field of Search ..... 464/181, 183; 175/90, 175/107, 320, 321, 324; 428/36.3

[56] References Cited

U.S. PATENT DOCUMENTS 3,489,231 1/1970 Garrison et al. .
4,171,626 10/1979 Yates et al. .
4,173,670 11/1979 VanAuken .
4,186,696 2/1980 Linsenmann .
4,271,915 6/1981 Bodine .
4,397,619 8/1983 Alliquander et al. .
4,421,497 12/1983 Federmann et al. .
4,664,644 5/1987 Kumata et al. .
4,679,638 7/1987 Eppink .
4,758,204 7/1988 Lingren .
4,976,655 12/1990 Hebert, Sr. .

FOREIGN PATENT DOCUMENTS 0196991 3/1986 European Pat. Off. .

*Primary Examiner*—Ramon S. Britts
*Assistant Examiner*—Frank S. Tsay
*Attorney, Agent, or Firm*—David W. Westphal; John E. Holder

[57] ABSTRACT

This invention relates to a composite torque shaft for connecting a downhole fluid motor to the drill bit at the end of a drill string. The composite torque shaft comprises an elongate matrix body with oriented fibers fixed therein. The fibers are particularly oriented to provide the composite torque shaft with significant torque strength and stiffness while allowing bending flexibility. Accordingly, the composite torque shaft converts the gyrating and rotating motion of the rotor in the fluid motor to the pure rotation of the drill bit.

31 Claims, 3 Drawing Sheets

DOWNHOLE FLUID MOTOR COMPOSITE TORQUE SHAFT

RELATED APPLICATIONS

This application is a continuation-in-part application of both U.S. application Ser. No. 07/725,695 and PCT application PCT/US91/04027. U.S. application Ser. No. 07/725,695 was filed on Jul. 3, 1991 now abandoned, and is a continuation of U.S. application Ser. No. 07/534,892 filed on Jun. 7, 1990now abandoned . PCT application PCT/US91/04027 was filed on Jun. 7, 1991 and is a continuation-in-part application of the above noted U.S. application Ser. No. 07/534,892 filed on Jun. 7, 1990.

FIELD OF THE INVENTION

This invention relates to downhole fluid motors of the type used at the end of a drill string for rotating a drill bit, and more particularly to the shafts for connecting fluid motors to drill bits.

BACKGROUND OF THE INVENTION

In well drilling operations, it is conventional to use a downhole fluid motor to rotate the drill bit when conducting special drilling operations such as, for example, directional drilling of boreholes. However, while downhole fluid motors of the progressive cavity type, also known as Moineau or positive displacement motors, have proven to be effective for generating rotational motion at the end of a drill string, there are inherent drawbacks related to the design of such motors. One particular drawback relates to the connection between the motor and the drill bit.

To fully understand the problem, one must understand the basic design of such fluid motors. In particular, fluid motors of the above type comprise a helical rotor positioned within the cavity of a helical stator. Drilling fluid, which is pumped down through the drill string to cool the drill bit and to carry drill cuttings to the surface, is directed down through the annulus between the rotor and stator to cause rotation of the rotor. However, the rotor does not simply rotate about a fixed vertical axis. The rotor rotates while gyrating, or translating along an orbital path. More particularly, the orbital path is not a simple circular orbit but rather an eccentrically orbital path typified by lateral excursions toward and away from the axis of the downhole fluid motor. Such complex gyrational and rotational motion of the rotor tends to be very demanding on the connecting shaft which connects the rotor to the drill bit and converts the gyrational and rotational motion to pure rotation.

Several arrangements have been developed for the design of the connecting shaft which have not been entirely satisfactory. A first arrangement for connecting the fluid motor to the drill bit and transforming the translating and rotating motion of the rotor to the pure rotation of the drill bit comprises a specially manufactured torque shaft. The special torque shaft is made of high strength, high quality steel and is machined to a near mirror surface finish. The high quality finish is necessary because the cyclical bending and flexing of the shaft would quickly cause fatigue cracking of the steel resulting in failure of the shaft. However, the metallurgical and production costs of such torque shafts are substantial and their reliability has been less than satisfactory. Moreover, such shafts have intrinsic design limitations which are particularly unsatisfactory. For example, in a large diameter drill string, the rotor follows a path having more exaggerated lateral excursions which result in increased bending stresses for the torque shaft.

A second arrangement is an articulated or double knuckle connector shaft which includes universal joints at opposite ends thereof. The universal joints obviate any bending stresses such as incurred by the above arrangement and are preferred in the larger diameter drill strings. However, the universal joints include seals which are subject to excessive wear and failure downhole. Also, in drill strings of less than 6½ inches in diameter, the universal joints must be of such a small size that the load bearing elements in the joints are subject to high shear stress. Therefore, the shaft has less than acceptable maximum allowable loading characteristics. This is a particular drawback for hard rock drilling where impact loading would exceed design limitations of the joints. Accordingly, the double knuckled connector has been less than fully satisfactory.

U.S. Pat. No. 4,679,638 issued Jul. 14, 1987 to Eppink discloses a torque shaft which comprises a flexible rod and a coaxial overload sub surrounding the flexible rod. The flexible rod is similar to the torque shaft in the first arrangement discussed above, however, its maximum torque strength need not be as great since the overload sub will carry a portion of the load. The overload sub includes splines which intermesh but do not normally engage with splines at the outer surface of the rod. When the rod twists beyond a predetermined deflection, the splines engage and the overload sub carries a portion of the load. However, this type of arrangement occupies more space than the above arrangements and the additional space may be critically important for achieving drilling fluid flow rates for drilling in particular types of formations. Moreover, the rod is still subjected to the same fatigue stresses as the torque shaft in the first arrangement above as well as the additional twisting deflections prior to the spline engagement. Thus, the rod may be prone to fatigue cracking.

Accordingly, it is an object of the present invention to provide a connector for a downhole fluid motor which overcomes the above noted disadvantages and drawbacks of the prior art.

It is a more particular object of the present invention to provide a connector for a downhole fluid motor which has high torque strength and stiffness characteristics while accommodating bending flexibility with minimal bending fatigue and failure.

SUMMARY OF THE INVENTION

The above and other objects are achieved by the present invention by a downhole fluid motor composite torque shaft comprising an elongate matrix body including a plurality of fibers fixed therein and which are oriented to provide the elongate matrix body with high torsional strength and stiffness while allowing bending flexibility. The torque shaft further includes a first coupling member at one end of the elongate matrix body for connecting to the rotor of the downhole fluid motor and a second coupling member at the Other end of said elongate matrix body for connecting to the drill bit.

BRIEF DESCRIPTION OF THE DRAWINGS

Some of the objects of the invention have been stated and others will appear as the description proceeds when taken in conjunction with the accompanying drawings in which.

DETAILED DESCRIPTION OF THE PREFERRED EMBODIMENT

Figure 1:
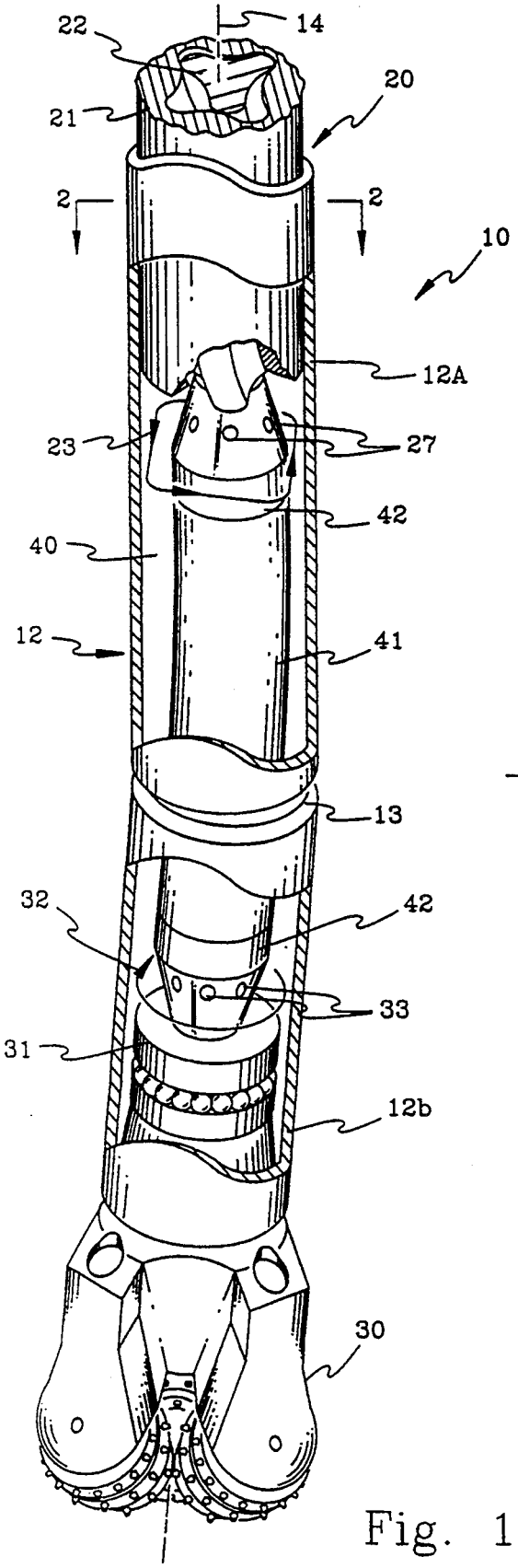
FIG. 1 is a top partially fragmentary perspective view of a downhole fluid motor assembly in accordance with a preferred embodiment of the present invention.

With reference to FIG. 1, a downhole fluid motor assembly is generally indicated by the numeral 10. The downhole fluid motor assembly 10 is connected to the end of a pipe string (not shown) for drilling a bore hole such as for an oil or gas well. The assembly 10 comprises a housing 12 which has a diameter generally corresponding with the diameter of the drill pipe in the drill string and includes suitable means (not shown) for connecting to the distal end of-the pipe string.

Figure 2:
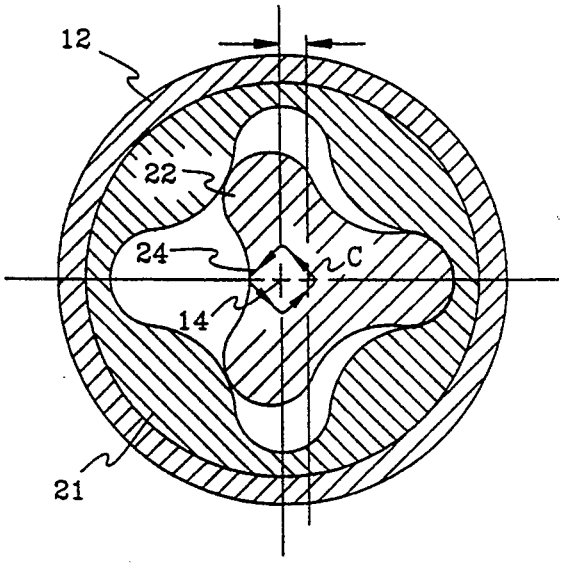
FIG. 2 is a cross sectional view of the downhole motor assembly taken along the line 2—2 of FIG. 1.

The housing 12 is an elongate hollow cylindrical tube having an axis 14 which in conventional drilling operations is vertical and coincides with the axis of the remainder of the drill string. The housing 12 includes an articulation joint 13 dividing the housing 12 into an upper portion 12*a* and a lower portion 12*b*. The articulation joint allows the lower portion 12*b* of the housing 12 to deviate from the axis 14 for altering the path of the drilling operation such as for directional drilling. A progressive cavity downhole fluid motor 20, sometimes referred to as a Moineau motor or a positive displacement motor, is secured inside the upper portion 12*a* of the housing 12. The motor 20, as best illustrated in FIG. 2, includes a stator 21 fixed to the inner surface of the housing 12 and a rotor 22 positioned within the stator 21 so as to rotate and gyrate under the force of drilling fluid being pumped down through the pipe string. Referring again to FIG. 1, a drill bit 30 projects from the end of the housing 12 for cutting through the earth during the drilling of the bore hole. The drill bit 30 is connected to a bearing set 31 which is secured within the housing 12 adjacent the lower end thereof. The bearing set 31 is a conventional device which includes bearing races and other means so as to allow free rotation about the axis 14 as indicated by the arrow 32 while preventing movement in other directions. The fluid motor 20 and the bearing set 31 are spaced apart in the housing 20 so as to define a torque shaft chamber 40. A torque shaft 41 is positioned within the torque shaft chamber 40 and is connected by its opposite ends to the rotor 22 and the bearing set 31. The torque shaft 41 thus provides the mechanical link between the downhole fluid motor 20 and the drill bit 30.

However, as discussed in the Background of the Invention above, the rotor 22 of the downhole fluid motor 20 does not simply rotate about the axis 14, but rather gyrates and rotates in a complex motion. Therefore, the conversion of the rotational and gyrational motion of the rotor 22 to the pure rotation of the drill bit 30 requires that the torque shaft have significant strength, stiffness, and durability. FIGS. 1 and 2 provide a general illustration of the problems posed by the downhole fluid motor 20 for the torque shaft 41. In particular, FIG. 1 illustrates the gyration of the rotor 22 as indicated by the arrows 23 as well as the resultant bending in the torque shaft 41 as should be apparent from the lateral displacement of the upper end of the torque shaft 41 from the axis 14. The movement of the rotor 22 within the stator 21 is also generally indicated in FIG. 2 wherein the rotor 22 has a central axis o which is spaced apart from the axis 14. During the operation of the motor 20, the axis C gyrates or orbits about the axis 14. However, the radial distance between the axes 14 and C is not constant, thus, the orbital path of the axis C about the axis 14 is thus not circular. The path indicated by arrow 24 is an eccentric orbital path having lobes of eccentricity Corresponding to the number of lobes in the stator. The eccentric lobes may be characterized as lateral excursions of the rotor 22 toward and away from the axis 14 which further bends the torque shaft 41. The bending of the torque shaft 41 is further compounded by the rotation about-axis C being opposite to the direction which the axis C orbits about axis 14 as indicated by the arrows 23 and 24 being opposite to the arrow 32.

Figure 3:
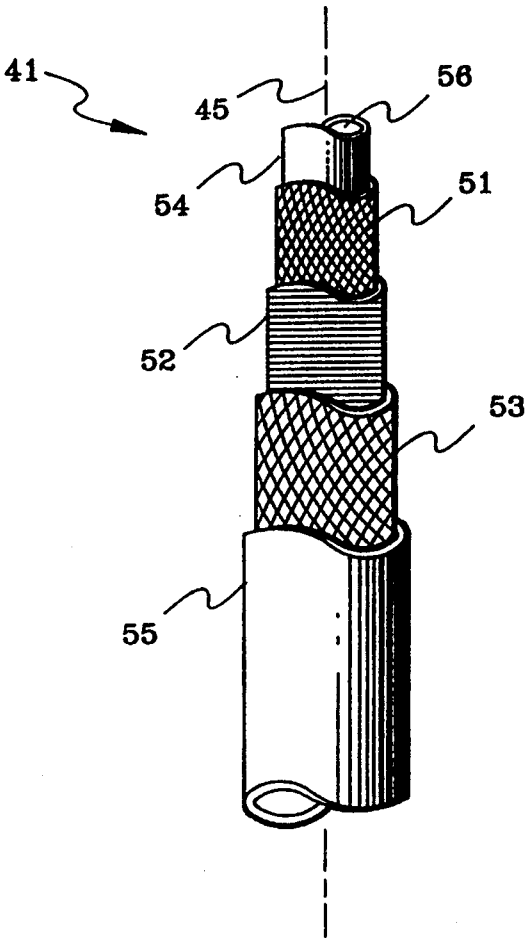
FIG. 3 is a front elevational view of a first embodiment of a torque shaft for the fluid motor assembly with parts broken away for clarity.

Accordingly, the torque shaft 41 of the present invention is particularly constructed to possess high torsional strength and stiffness while having bending flexibility or in other words substantial bending fatigue strength to withstand the continuous cyclic bending inherent in the downhole fluid motor assembly Referring to FIG. 3, the torque shaft 41 is more clearly illustrated with portions of the shaft 41 broken away to better show its structure and construction. The torque shaft 41 is a composite material formed of a matrix body having oriented fibers fixed therein. The fibers each have significant axial strength and, thus, the orientation and number of the fibers determine strength and bending characteristics of the composite torque shaft 41.

The construction of the composite torque shaft 41 is based on procedures known in the composite materials field. Briefly, the process comprises the steps of laying up resin coated fibers in predetermined orientations and treating the resin so as to coalesce and harden to form the resin matrix body. Suitable fibers for use in the composite torque shaft 4 include carbon fibers, E-glass fibers, S-glass fibers, aramid fibers as well as others. Moreover, it may be preferable to use combinations of different fibers to achieve desirable characteristics for the shaft 41. Each of the fibers have different strength and stretch characteristics as well as cost considerations so that one may be more appropriate for some circumstances while another may be better for another situation. Any suitable resin may be used to form the resin matrix body such as a thermoset epoxy resin or a thermoplastic resin. Two representative materials which may be used are Fiberite 977-3 epoxy and bismaleimide.

As an alternative to resin matrix composites, the composite torque shaft 41 may be made of a metal matrix composite wherein the body is formed of a metal matrix binder such as titanium, aluminum or other suitable metal. The metal matrix binder fixes oriented fibers made of silicon carbide, boron carbide or other suitable material. Such composite materials are able to operate in higher temperature environments and are more resistant to corrosion and abrasion than the previously described matrix binder.

The composite torque shaft 41 includes suitably shaped connector ends 42 for connecting the shaft 41 to the rotor 22 and the bearing set 31. The connector ends 42 may also include metal inserts or other strength and reinforcing members to provide a satisfactory connection.

In the preferred embodiment, the composite torque shaft 41 comprises layers of oriented fibers overlaid one upon the other. The illustrated embodiment includes three layers 51, 52 and 53, however, this is for clarity and explanation purposes. The preferred embodiment comprises substantially more layers, such as twenty or more wherein each layer has a thickness of between 0,003 and 0.04 inches.

Referring to FIG. 3, the composite torque shaft 41 includes a first fiber layer 51 comprising fibers oriented in across-ply pattern. The cross-ply pattern, as will be further explained hereafter, provides substantial torsional strength for the composite torque shaft 41 without introducing significant resistance to bending. For clarity, the fiber orientation is specified in terms of an angle $\theta$ formed between the fiber and the axis 45 of the composite torque shaft 41. The fibers are cross-plied at an angle $\theta$ in the range of between 30 and 60 degrees with respect the axis 45 and expressed as "+/−" such as +/−45 degrees. The second fiber layer 52 comprises fibers oriented approximately 90 degrees with respect to the axis 45 of the composite torque shaft 41 or generally circumferential oriented. The 90 degree or generally circumferential orientation provides integral strength or structural integrity for the composite torque shaft 41 without impairing the bending flexibility thereof. A third fiber layer 53 is generally similar to the first layer 51 in that the fibers are again arranged in a cross-ply pattern. However, the fiber orientation of the third fiber layer 53 may be selected to be a different $\theta$ angle while still being in the range of 30 to 60 degrees with respect to the axis 45. As shown below, the angle +/−45 degrees provides the maximum torsional stiffness, thus, the preferred angle is approximately +/− 45 degrees.

One particularly noteworthy attribute of the generally circumferentially oriented fibers in the second fiber layer 52 is to resist the nonlinear "scissor-like" inner-laminar shear deformations of the cross-ply oriented fibers in response to compression loading.

Axial compressive loads are commonly endured by all downhole fluid motor torque shafts which at times are quite substantial and in combination with torsion loads are a substantial contributor to failure for such torque shafts. Cross-ply oriented fibers provide the primary resistance to torsion loads, however, a laminate composed of all cross-ply oriented fibers is not an efficient laminate to carry compression loads and such a laminate responds to the application of compression loads with a significant amount of nonlinear "scissor-like" (i.e., the cross-ply fibers appear to be opening or closing like a pair scissors) shear deformations. The circumferentially oriented fibers increase the axial stiffness and strength of the laminate compared to the axial stiffness of a laminate composed of all cross-ply oriented fibers. For example, a carbon fiber epoxy laminate composed of 90 percent ±45 degree oriented plies and 10 percent 90 degree oriented plies has an axial stiffness approximately 40 percent higher than a laminate of equal thickness composed of fibers all oriented at ±45 degrees. This stiffening is accomplished without significant reduction in the shear modulus of the laminate required to carry torsion loaded. In the case cited above the inclusion of 10 percent 90 degree plies reduces the shear stiffness of the laminate by approximately 10 percent.

With respect to the precise angle of the generally circumferentially oriented fibers, there are other considerations that would make it preferable to modify the angle somewhat from the preferred angle of approximately 90 degrees. For example, for manufacturing purposes, the generally circumferentially oriented fibers may have as much as a 10 degree variation or more from the 90 degree circumferential orientation. In other words, the generally circumferential fibers are oriented at an angle relative to the axis of the torque shaft 41 of approximately-80 degrees or greater. While it is preferred for the angle to be closer to 90 degrees, at about 80 degrees, it may be suitable to have the generally circumferentially oriented fibers cross-plying in a cross-ply arrangement.

Figure 6:
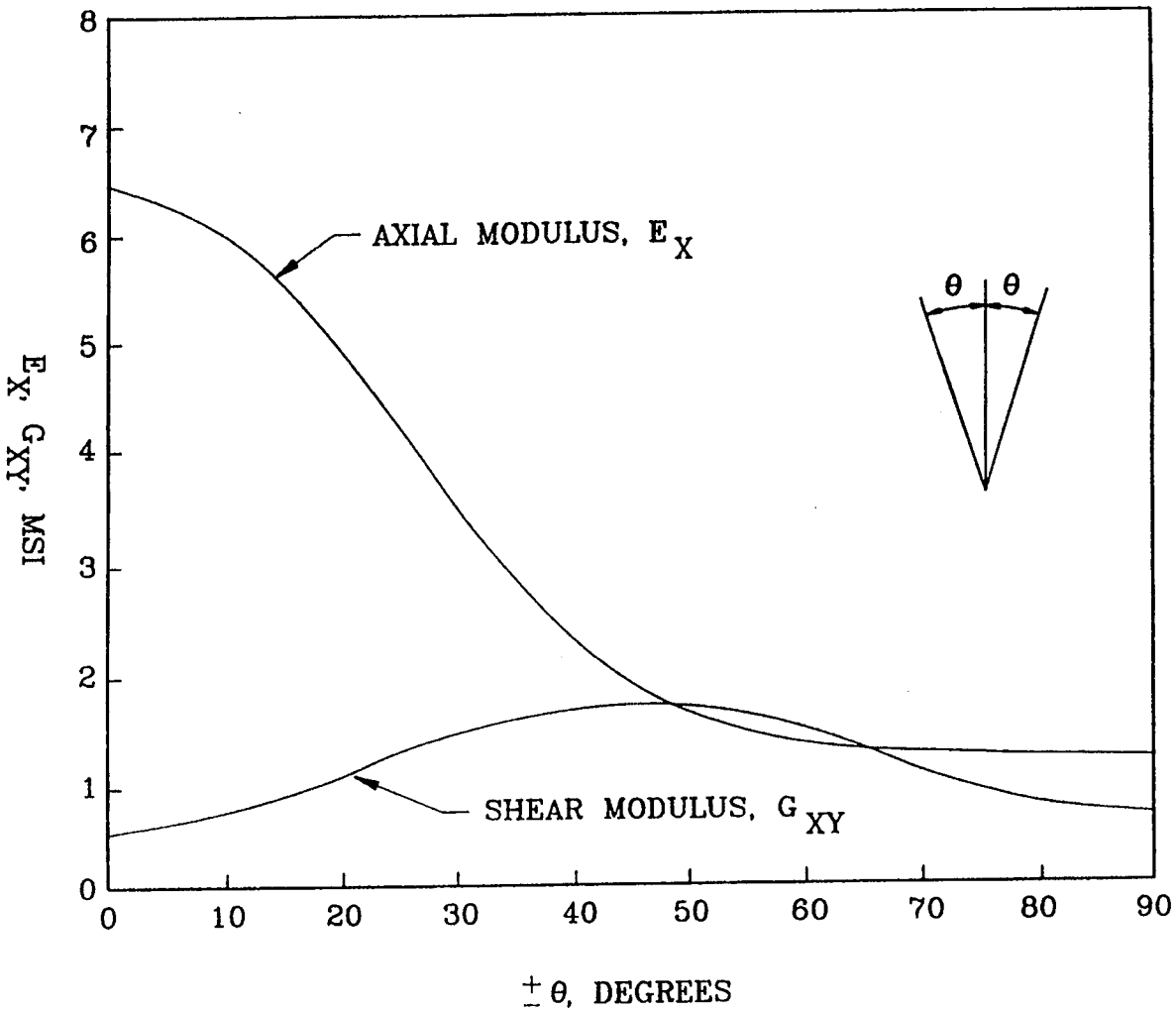
FIG. 6 is a graph generally illustrating the axial and shear moduli for a composite tube having fibers in a cross-ply pattern in a range of angles with respect to the axis of the tube.

As noted above, the composite torque shaft 41 comprises a significant number of fibers oriented in a cross-ply pattern so as to provide torsional strength and stiffness without introducing significant resistance to bending. Referring to FIG. 6, the graph indicates a general relationship of the fiber orientation angle $\theta$ and a cross-ply fiber layer to the axial modulus (which effects the resistance to bending) and the shear modulus (which relates to the torsional strength and stiffness characteristics) of the composite torque shaft 41. This graph is based upon a composite tube formed of E-glass fibers with an epoxy resin matrix. While other combinations may have markedly different values for each modulus, the general relationships between the cross-ply angles and moduli will be quite similar. For example, as noted from the graph, the axial modulus is substantially reduced when the angle between the axis 45 is increased from zero degrees (parallel to the axis 45) to approximately 45 degrees. The higher the axial modulus, the stiffer the composite shaft will be in bending. At the same time, the shear modulus is maximized at approximately 45 degrees, which translates to the maximum torsional stiffness for the composite torque shaft 41. Thus, a cross-ply pattern of generally between 30 and 60 degrees will provide the desired characteristics of the composite torque shaft 41. As noted from the graph in FIG. 6, the fiber orientation angle of approximately +/−45 degrees would be preferred so as to provide maximum torsional strength and stiffness combined with low bending resistance. However, other factors may be considered in the preferred angle. For example, if the shaft 41 is hollow and carries internal fluids under pressure, an angle of less than +/−45 degrees would be preferred to accommodate the added stresses due to such internal pressure. On the other hand, if the shaft is to carry exceptional compression loads, it would be desirable to have the angle be greater than +/31 45 degrees.

Referring again to FIG. 3, the preferred embodiment of the torque shaft 41 is a hollow tube as noted by the hollow internal passageway 56. As such, the composite shaft 41 will be of minimal weight and the material will be concentrated in the circumference of the tube to provide high torsional strength and stiffness. The hollow tube embodiment may also provide an alternative path 56 for drilling fluid to pass through the torque shaft chamber 40 to the drill bit 30. As illustrated in FIG. 1, the shaft has a large diameter compared to the space available in the torque shaft chamber 40 so as to provide the necessary torque load capacity. The path for the drilling fluid through the interior of the shaft 41 allows a sufficient volume of drilling fluid to drive the downhole fluid motor 20 and lubricate the bit 30. Moreover, the hollow internal flow path 56 does not sacrifice the strength and stiffness characteristics of the composite torque shaft 41 while obtaining the desired flow rate.

The drilling fluid may be allowed to enter and exit the torque shaft 41 by any suitable means. In FIG. 1, there is indicated passages 27 in the lower end of the rotor 22 which connects to the shaft 41. The passages allow drilling fluid to be directed into the internal passageway 56. The bearing set 31 includes a connector at the upper portion thereof for connecting to the composite torque shaft 41. In the connector there are passages 33 allowing the drilling fluid to exit from the internal passageway 56 back to the torque shaft chamber 40 below the composite torque shaft. A part or all the fluid passing through the internal passageway 56 may alternatively be directed through the center of the bearing set 31 to the bit 30. Another suitable arrangement (not shown) for directing the drilling fluid through the internal passageway includes engineering slots into the composite torque shaft 41 leading to the internal passageway.

In a preferred aspect of the present invention, the torque shaft 41 further includes an outer protective layer 55 to protect the outer surface of the matrix body from abrasion, wear or corrosion in the hostile downhole environment. Also, the composite torque shaft 41 may further comprise, as an optional feature, a protective liner 54 to line the hollow inner surface of the matrix body to protect the same from abrasion, wear and corrosion. The liner 54 may further serve as a mandrel or form for manufacturing the composite torque shaft 41. The outer protective layer 55 and liner 54 may be made from any suitable material, such as for example an elastomer such as a polyurethane, or fluroelastomer with or without fiber reinforcement such as aramid pulp, or a metal such as aluminum, titanium, or steel etc.

Figure 4:
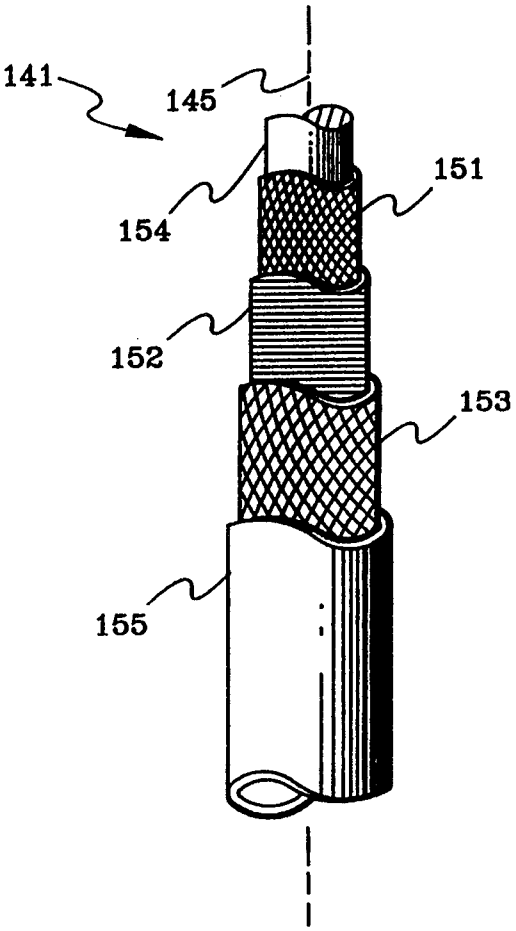
FIG. 4 is a front elevational view similar to FIG. 3 of a second embodiment of a torque shaft for the fluid motor assembly.

A second embodiment of the composite torque shaft is generally indicated by the numeral 141 in FIG. 4 and is very similar to the first embodiment. Therefore, similar features are indicated by the same numbers with a prefix of "1". For example, the composite torque shaft of the first embodiment is indicated by the number 41 and the composite torque shaft of the second embodiment is indicated by the number 141. The primary difference between the second embodiment of the composite torque shaft 141 and the first embodiment is that the second embodiment is a solid shaft. More particularly, the composite torque shaft 141 includes a solid rod 54 with the matrix body overlying the rod 154. The rod 154 may be formed of any suitable material such as a resin or an elastomer and serves as an excellent mandrel for laying up the fibers. In one preferred arrangement the rod 154 is formed of a metal such as aluminum or steel. Oriented fiber layers 151, 152, and 153 overlie the rod and are fixed in a matrix body similar to the first embodiment in FIG. 3. The composite torque shaft 141 further includes connector ends 142 and may be provided with a protective outer layer 155 similar to the protective outer layer 55 in the first embodiment.

Figure 5:
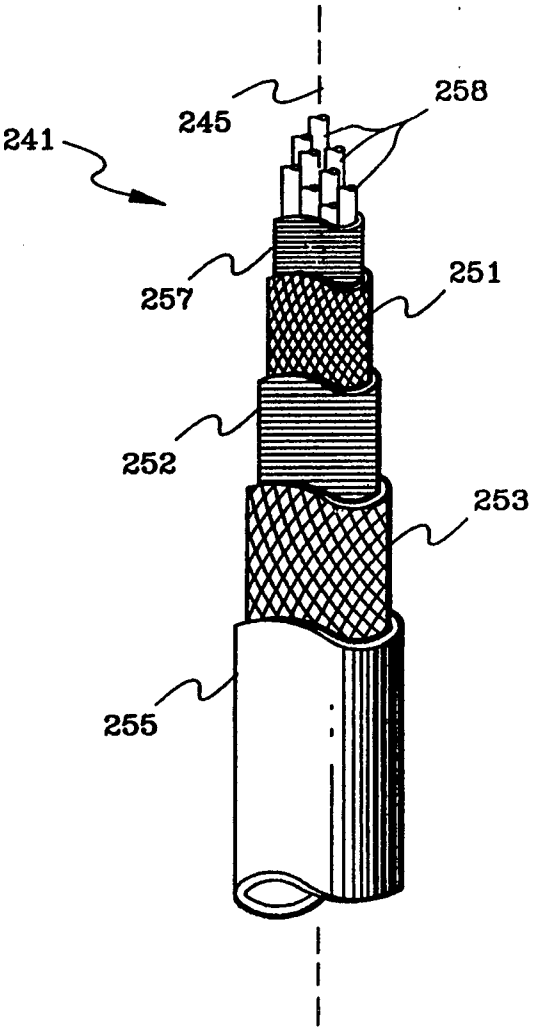
FIG. 5 is a front elevational view similar to FIG. 3 of a third embodiment of a torque shaft for the fluid motor assembly.

A third embodiment of the composite torque shaft is generally indicated by the numeral 241 in FIG. 5 and is very similar to the first embodiment. Therefore, similar features are indicated by the same numbers with a prefix of "2". For example, the composite torque shaft of the first embodiment is indicated by the number 41 and the composite torque shaft of the second embodiment is indicated by the number 241. The primary difference between the third embodiment of the composite torque shaft 241 and the first embodiment is that the second embodiment includes a plurality of composite rods 258 within the hollow shaft The composite rods 258 are preferably small diameter, parallel composite rods made with axially oriented fiber such as graphite, carbon, aramid, boron or other high modulus fiber, formed in a resin matrix such vinyl ester, epoxy, nylon, etc. so as to provide substantial axial strength for the torque shaft 241. At times during downhole operations, the compression load on the composite torque shaft 41 can become quite substantial. Since the composite torque shaft 41 is bent and offset while installed in the housing 12, axial compression loading can cause buckling and failure thereof. Due to their small diameter, the composite rods 258 individually have low bending stiffness. Moreover, they are positioned near the axis of the composite torque shaft and are preferably able to move relative to one another. As such they do not significantly impair the bending stiffness of the composite torque shaft while providing substantial axial strength.

The third embodiment further differs from the first embodiment by not including the protective liner 54. Since there is no material flowing through the interior thereof to protect the composite torque shaft from. Another composite layer 257 is shown in FIG. 5 but, as noted above, the drawing FIGS. 3 through 5 have been simplified for explanation purposes and any preferred embodiment would contain a number of layers of oriented fibers and the third embodiment would not necessarily include more or less layers than the first or second embodiments.

In the drawings and specification, there has been set forth embodiments of the invention, and although specific terms are employed, they are used in a generic and descriptive sense only and not for purposes of limitation.

We claim:

1. A downhole fluid motor composite torque shaft for connecting a downhole fluid motor to a drill bit at the distal end of a drill string, wherein the fluid motor is of the type positioned adjacent to the end of a drill string and includes a rotor which rotates and gyrates about a common axis of the drill string under the force of drilling fluid being pumped down through the drill string to the bit to flush drill cuttings up through the annulus around the drill string, and wherein the composite torque shaft converts the rotating and gyrating motion to pure rotation for the drill bit, the composite torque shaft comprising:

an elongate body having a longitudinal axis and comprising a plurality of overlying layers of fibers fixed in a matrix binder wherein each fiber layer includes a plurality of fibers oriented in a predetermined angle with respect to said longitudinal axis to provide said elongate body with high torsional strength and stiffness while allowing bending flexibility;

a first coupling member at one end of said elongate body for providing a drive connection with the rotor of the downhole fluid motor; and a second coupling member at the other end of said elongate body for providing a drive connection with the drill bit;

wherein at least some of said fiber layers have a predetermined orientation of between 30 and 60 degrees with respect to said longitudinal axis and at least a substantial portion of the immediately aforementioned layers include additional fibers which are oriented at a reciprocal angle of the predetermined angle with respect to said longitudinal axis so that such fiber layers have cross-plying fibers, and further wherein at least one of said fiber layers includes fibers oriented at approximately 80 degrees or greater with respect to said longitudinal axis of said elongate body and said approximately 80° degree or greater oriented fibers extend substantially along the length of said elongate body between said coupling members.

2. The composite torque shaft according to claim 1 wherein at least one of said layers including fibers oriented at approximately 80 degrees or greater includes fibers oriented at approximately 90 degrees with respect to said longitudinal axis of said elongate body.

3. The composite torque shaft according to claim 1 wherein said binder is a thermoset resin.

4. The composite torque shaft according to claim 1 wherein said binder is a thermoplastic resin.

5. The composite torque shaft according to claim 1 wherein said fibers are comprised of one of carbon fibers, E-glass fibers, S-glass fibers, aramid fibers, or a combination of different fibers.

6. The composite torque shaft according to claim 1 wherein said matrix binder is a metal.

7. The composite torque shaft according to claim 1 wherein said matrix binder is aluminum.

8. The composite torque shaft according to claim 1 wherein said matrix binder is titanium.

9. The composite torque shaft according to claim 1 wherein said fibers are made of silicon carbide.

10. The composite torque shaft according to claim 1 wherein said fibers are made of boron.

11. The composite torque shaft according to claim 1 wherein said elongate body overlies an elongate metal rod.

12. The composite torque shaft according to claim 1 wherein said elongate matrix body overlies a hollow metallic liner.

13. The composite torque shaft according to claim 1 wherein said elongate body comprises an elongate hollow cylindrical tube.

14. The composite torque shaft according to claim 13 further comprising protective layers overlying and bonded to the inner surface of said elongate tube to protect said tube from wear and abrasion.

15. The composite torque shaft according to claim 1 further comprising a plurality of generally parallel elongate composite rods extending generally longitudinally through said elongate body.

16. The composite torque shaft according to claim 1 further comprising an elastomer protective outer layer overlying and bonded to the outer surface of said elongate body to protect said body from wear and abrasion.

17. The composite torque shaft according to claim 1 further comprising an metal protective outer layer overlying and bonded to the outer surface of said elongate body to protect said body from wear and abrasion.

18. An apparatus for attachment to the distal end of a pipe string for drilling a borehole into the earth, the apparatus comprising:

an elongate hollow tubular housing having a first end for being coaxially connected to the distal end of the pipe string and an opposite distal end adapted to extend toward the bottom of the borehole;

a fluid motor mounted inside said housing and including rotation output means for generating gyrational and rotational motion under the force of drilling fluid being pumped down through the pipe string and through said housing;

a drill bit rotatably mounted at said distal end of said housing for boring into the earth; and a composite torque shaft for connecting said output means of said fluid motor to said drill bit and comprising an elongate body having a longitudinal axis and comprising a plurality of overlying layers of fibers fixed in a matrix binder wherein each fiber layer includes a plurality of fibers oriented at a predetermined angle with respect to said longitudinal axis to provide said elongate body with high torsional strength and stiffness while allowing bending flexibility, a first coupling member at one end of said elongate body and connected to said output means of said fluid motor, and a second coupling member at the other end of said elongate body and connected to said drill bit, wherein at least some of said fiber layers have a predetermined orientation of between 30 and 60 degrees with respect to said longitudinal axis and at least a substantial portion of the immediately aforementioned layers include additional fibers which are oriented at a reciprocal angle to the predetermined angle with respect to said longitudinal axis so that such fiber layers have cross-plying fibers, and further wherein at least one of said fiber layers includes fibers oriented at approximately 80 degrees or greater with respect to said longitudinal axis of said elongate body and said approximately 80 degree oriented fibers extend substantially along the length of said elongate body between said coupling members.

19. The apparatus according to claim 18 wherein said matrix binder is a thermoset epoxy resin.

20. The apparatus according to claim 18 wherein said matrix binder is a thermoplastic resin.

21. The apparatus according to claim 18 wherein said fibers are comprised of one of carbon fibers, E-glass fibers, S-glass fibers, aramid fibers.

22. The composite torque shaft according to claim 18 wherein said matrix binder is a metal.

23. The composite torque shaft according to claim 22 wherein said metal is aluminum.

24. The composite torque shaft according to claim 22 wherein said metal is titanium.

25. The composite torque shaft according to claim 18 wherein said fibers are made of silicon carbide.

26. The composite torque shaft according to claim 18 wherein said fibers are made of boron carbide.

27. The apparatus according to claim 18 wherein said elongate body overlies an elongate metal rod.

28. The apparatus according to claim 18 wherein said elongate body overlies a hollow metallic liner.

29. The apparatus according to claim 18 wherein said elongate body comprises an elongate hollow cylindrical tube.

30. The apparatus according to claim 18 further comprising a protective outer layer overlying and bonded to the outer surface of said elongate body to protect the same from wear and abrasion.

31. The composite torque shaft according to claim 18 further comprising a plurality of generally parallel elongate composite rods extending generally longitudinally through said matrix body.

* * * * *